US010648439B2

(12) United States Patent
Pohlmann et al.

(10) Patent No.: US 10,648,439 B2
(45) Date of Patent: May 12, 2020

(54) SYSTEM HAVING A FUEL DISTRIBUTOR AND MULTIPLE FUEL INJECTORS

(71) Applicant: Robert Bosch GmbH, Stuttgart (DE)

(72) Inventors: Jens Pohlmann, Bietigheim-Bissingen (DE); Thilo Bolz, Kraichtal (DE); Ralph Ittlinger, Weissach (DE); Goekhan Guengoer, Eberdingen (DE); Thomas Froihofer, Brackenheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/397,383

(22) PCT Filed: Mar. 22, 2013

(86) PCT No.: PCT/EP2013/056165
§ 371 (c)(1),
(2) Date: Oct. 27, 2014

(87) PCT Pub. No.: WO2013/160038
PCT Pub. Date: Oct. 31, 2013

(65) Prior Publication Data

US 2015/0330347 A1 Nov. 19, 2015

(30) Foreign Application Priority Data

Apr. 26, 2012 (DE) ..... 10 2012 206 887

(51) Int. Cl.
*F02M 61/14* (2006.01)
*F02M 41/00* (2006.01)
*F02M 61/16* (2006.01)

(52) U.S. Cl.
CPC ..... *F02M 61/14* (2013.01); *F02M 41/00* (2013.01); *F02M 61/168* (2013.01); *F02M 2200/8023* (2013.01); *F02M 2200/853* (2013.01)

(58) Field of Classification Search
CPC ..... F02M 61/14; F02M 2200/853; F02M 61/168; F02M 2200/852; F02M 2200/856;
(Continued)

(56) References Cited

U.S. PATENT DOCUMENTS 4,307,693 A * 12/1981 Glockler ..... F02M 55/004 123/469
4,436,112 A * 3/1984 Atkins ..... F02M 69/044 137/510
(Continued)

FOREIGN PATENT DOCUMENTS

CN 102046958 A 5/2011
DE 2617565 11/1977
(Continued)

OTHER PUBLICATIONS

International Search Report for PCT/EP2013/056165, dated Jul. 12, 2013.

*Primary Examiner* — Long T Tran
(74) *Attorney, Agent, or Firm* — Norton Rose Fulbright US LLP; Gerard Messina

(57) ABSTRACT

A system, which is used especially as a fuel injection system for the high-pressure injection in internal combustion engines, includes a fuel distributor and a plurality of fuel injectors. Each fuel injector is situated on a cup of the fuel distributor. At least one of the fuel injectors is fastened to the associated cup by a holding element. The holding element has an at least essentially straight first leg and an at least essentially straight second leg. The cup includes at least one recess, which extends through a wall of the cup. The first leg and the second leg are guided through the at least one recess. Furthermore, the connection sleeve of the fuel injector has a collar, which is braced on the first leg of the holding
(Continued)

element and on the second leg of the holding element in order to secure the fuel injector on the cup.

37 Claims, 4 Drawing Sheets

(58) Field of Classification Search
CPC ..... F02M 51/0682; F02M 69/465; F02M 2200/8061; F02M 2200/855; F02M 55/004; F02M 2200/8015; F02M 2200/8023; F02M 2200/803; F02M 2200/857; F02M 35/1021
USPC ..... 123/470, 445, 468, 469, 471; 239/398–408
See application file for complete search history.

(56) References Cited

U.S. PATENT DOCUMENTS 4,570,602 A 2/1986 Teransu et al.
4,993,390 A * 2/1991 Ono ..... F02M 55/004 123/456
5,979,411 A * 11/1999 Ricco ..... F02M 55/002 123/469
6,019,089 A * 2/2000 Taylor ..... F02M 61/145 123/456
6,148,799 A * 11/2000 Leipelt ..... F02M 35/10078 123/469
7,556,022 B1 * 7/2009 Doherty ..... F02M 55/004 123/456
7,938,455 B2 5/2011 Rapp
2004/0045530 A1 * 3/2004 Schoeffler ..... F02M 55/004 123/457
2004/0237939 A1 * 12/2004 Kondo ..... F02M 61/145 123/470
2004/0244776 A1 * 12/2004 Aota ..... F02M 51/0678 123/470
2007/0295309 A1 * 12/2007 Zdroik ..... F02M 55/005 123/470
2009/0056674 A1 * 3/2009 Furst ..... F02M 61/14 123/470

FOREIGN PATENT DOCUMENTS

DE 9216362 U1 1/1993
DE 102005020380 11/2006
DE 102006038841 2/2008
EP 0102164 3/1984
FR 2637021 A1 3/1990
GB 2051951 1/1981
JP S56-12051 A 2/1981
JP S59-70873 A 4/1984
JP 2008-255983 A 10/2008
JP 2010-501055 A 1/2010
JP 2010-168965 A 8/2010
JP 2011-11-04 A 11/2011
JP 2011220259 A 11/2011
WO WO02/073025 9/2002

* cited by examiner

SYSTEM HAVING A FUEL DISTRIBUTOR AND MULTIPLE FUEL INJECTORS

FIELD OF THE INVENTION

The present invention relates to a system, especially a fuel injection system, for the high-pressure injection in internal combustion engines, having a fuel distributor and multiple fuel injectors. The present invention more specifically pertains to the field of fuel-injection systems for mixture-compressing internal combustion engine featuring external ignition, in which fuel is injected directly into the combustion chambers of the internal combustion engine.

BACKGROUND INFORMATION

German Published Patent Application No. 10 2005 020 380 describes a fuel injection device which is characterized by a noise-decoupling design. The known fuel injection device includes at least one fuel injector, a holder for the fuel injector in a cylinder head, and a fuel distributor line provided with a pipe connection, into which the fuel injector is inserted in a partially overlapping manner. A holding-down clamp is provided between the fuel injector and pipe connection in order to set the fuel injector and fuel distributor line apart from each other, free of radial forces, and in order to hold down the fuel injector in the receiving bore of the cylinder head in a secure manner. The holding-down clamp is developed as a bracket-shaped component. When installed, the holding-down clamp rests against a downstream end face of the pipe connection on the fuel distributor line via a holding-down bracket. The fuel injector is suspended inside a connection element that has a tubular design. A holding collar of the connection element grips the fuel injector from below at a housing shoulder, so that the fuel injector, set apart from a radially extending shoulder of the receiving bore, hangs freely.

The fuel injection device known from German Published Patent Application No. 10 2005 020 380 has the disadvantage that the number and complexity of the mounting elements is high, which means that the work involved in the initial assembly during the manufacture and also in a deinstallation and reinstallation in a service situation is considerable as well.

SUMMARY

The system according to the present invention has the advantage of providing a better design. In particular, it is advantageous that the number and complexity of the mounting elements is able to be reduced, so that the effort involved in the initial assembly during the production and in a possible deinstallation and reinstallation in a service situation is limited. Especially the number and complexity of the mounting element can be reduced to a minimum. Another potential advantage is that the mounting allows the fuel injector to pivot within certain limits, provided the geometry of the fuel injector and the geometry of the cup are specified appropriately. This allows a radial tolerance compensation between the cup on the fuel distributor and, for example, a valve bore in the cylinder head.

The system is especially suitable for internal combustion engines having direct gasoline injection. In such a case, the fuel distributor may be designed as a fuel distributor rail, in particular. The fuel rail is used for storing fuel under high pressure and for distributing the fuel among the fuel injectors. In this instance, the fuel injectors may be designed as high pressure injectors, in particular. The fuel injectors inject the fuel required for the combustion process into the respective combustion chamber under high pressure. To do so, the fuel is compressed by a high-pressure pump and conveyed in controlled quantities into the fuel distributor via a high-pressure line.

The system may advantageously be designed as a fuel injection system. The fuel distributor is able to be suitably connected to an add-on structure, especially to a cylinder head of an internal combustion engine. It may consist of multiple parts and, for example, include a main pipe, a holder, the cups (valve cups) for accommodating the fuel injectors, a connection for the pressure sensor, and a customer terminal. The individual parts and the possibly provided add-on components can be soldered directly to the main pipe. This complete subassembly is then able to be hard-bolted directly to the cylinder head, for instance via the holders, but other securing types are possible as well.

It is conceivable that the force generated by the internal pressure of the fuel and possibly by suitable holding-down elements presses the fuel injectors, which are secured in the cups of the fuel distributor, against an axial stop on the cylinder head when the fuel injectors are inserted in corresponding bores of the cylinder head. However, this has the disadvantage that a metal contact results between the contact surface of the fuel injector on the cylinder head. The noise generated by the fuel injectors is thereby transmitted directly into the vehicle structure. Since the collar of the fuel injector is braced on the legs of the holding elements, the bracing on the cylinder head is canceled. This also cancels the metallic contact, and the direct noise transmission is reduced.

This results in a reduction of the acoustic paths between, for example, a cylinder head, the fuel distributor and the fuel injectors that enable a transmission of structure-borne noise. Especially the source of the sound excitation can be mechanically decoupled from the cylinder head and similar elements.

The holding element therefore allows an axial mechanical separation of the fuel injectors from the cylinder head or the like, since the fuel injectors are able to be secured directly on the cups. The number of mounting elements and their complexity can be reduced to a minimum.

It is advantageous that the first leg and the second leg lie at least approximately in a plane that runs at a right angle to a longitudinal axis of the cup of the fuel injector. The forces that are produced in particular by the internal pressure of the fuel and that act on the holding element in the axial direction are therefore advantageously absorbed by the legs of the holding element. This avoids a force component on the holding element perpendicular to the longitudinal axis.

It is furthermore advantageous that the first leg and the second leg of the holding element are not aligned parallel with each other in an initial state. The first leg and the second leg of the holding element are advantageously pivoted relative to each other in order to clamp the holding element in the at least one recess. In one development of the holding element, for example, in which the legs are not aligned parallel with each other in the initial state, a clamping force is able to be generated by positioning the legs in parallel and inserting them into the at least one recess. This clamping force then securely fixates the holding element on the cup.

It is also advantageous that a contact surface is developed on the first leg of the holding element, at which the collar of the connection sleeve of the fuel injector is resting against the first leg, and/or that a contact surface is developed on the second leg of the holding element, at which the collar of the connection sleeve of the fuel injector is resting against the second leg. The development of the contact surfaces on the legs of the holding element makes it possible to enlarge the contact surface between the collar of the fuel injector and the holding element. This results in greater loading capacity, which makes the system suitable for higher operating pressures. In addition, a keyed connection is able to be achieved in the process.

For it is also advantageous that a keyed connection is formed between the first leg of the holding element and the collar of the connection sleeve of the fuel injector, which secures the holding element in relation to the cup, and/or that a keyed connection is formed between the second leg of the holding element and the collar of the connection sleeve of the fuel injector, which secures the holding element in relation to the cup. The keyed connection may be provided in addition or as an alternative to a clamping force. The keyed connection prevents the holding element from falling out over the course of its service life. For example, the keyed connection can be achieved by a suitable design of the contact surface on the first leg or the contact surface on the second leg. The contact surface of the first leg may be realized by an embossed region, in particular, and the contact surface of the second leg may be realized by another embossed region.

It is furthermore advantageous that the first leg of the holding element has an at least approximately rectangular profile, and/or that the second leg of the holding element has an at least approximately rectangular profile. In particular, the entire holding element may have an at least roughly rectangular profile. The rectangular profile, for example, may be varied locally using suitable embossed areas.

It is also advantageous that in the region of the fuel injector, the first leg has a fixation segment, which is bent radially outward in relation to a longitudinal axis of the cup or the connection sleeve of the fuel injector, and/or that in the region of the fuel injector, the second leg has a fixation segment that is bent radially outward in relation to the longitudinal axis of the cup or the connection sleeve of the fuel injector. In particular, the connection sleeve of the fuel injector may advantageously be provided with a contact surface which is at least partially shaped like a cylinder sleeve, it being possible for the fixation segment of the first leg and the fixation segment of the second leg to rest against the contact surface of the connection sleeve of the fuel injector. This enables the creation of a keyed connection between the holding element and the connection sleeve of the fuel injector, which prevents the holding element from falling out.

It is furthermore advantageous that the holding element has a bracket that connects the first leg to the second leg, and that a stop is formed on the bracket, which strikes an outer side of the cup. This specifies a defined end position of the holding element on the cup during the assembly, and thereby ensures a correct installation position. For example, the stop of the bracket may be formed by a bent part of the bracket. This allows a cost-effective development of the holding element. However, another option consists of realizing the stop of the bracket by a stop part that is linked to the bracket. Such a stop part in particular may be realized by a plastic extrusion coat, which is extruded onto the bracket. This, too, makes it possible to realize a stop on the bracket.

To simplify the mounting of the holding element on the cup, the two at least essentially straight legs of the holding element may also have different lengths. This allows an uneven insertion into the at least one recess, which improves the assembly. In particular, it is possible to provide two recesses in the cup, which are preferably developed in the form of through holes. Each leg of the holding element can then be guided through one of the through holes. The development of the holding element featuring different leg lengths allows an uneven insertion into the through holes.

DETAILED DESCRIPTION

Figure 1:
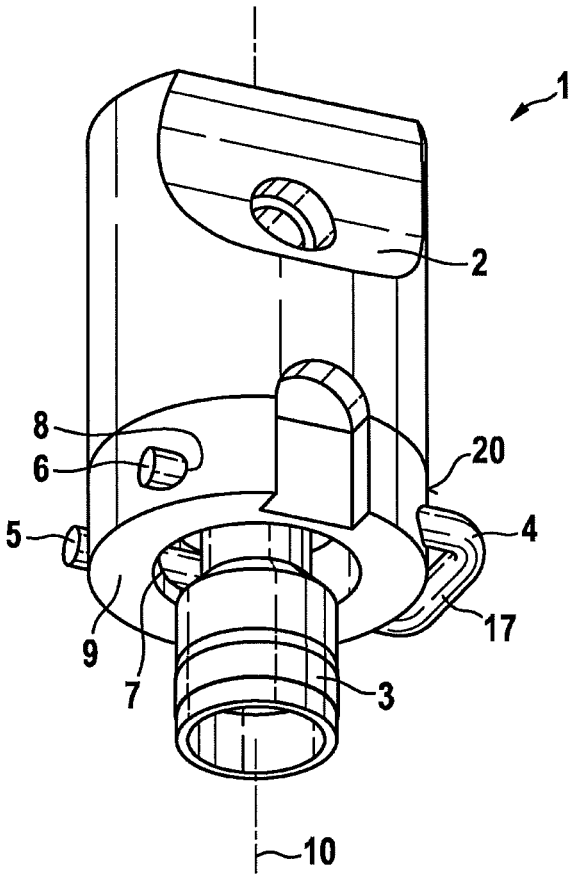
FIG. 1 a system including a cup of a fuel distributor and a fuel injector in an excerpted, schematic three-dimensional representation corresponding to a first exemplary embodiment of the present invention.

FIG. 1 shows an excerpted schematic three-dimensional view of a system 1 having a cup 2 and a connection sleeve 3 of a fuel injector, according to a first exemplary embodiment. System 1 has a plurality of such cups 2, which are interconnected via a preferably longitudinal tubular base element. This forms a fuel distributor, which may be developed as fuel distributor rail, in particular. The fuel injectors are situated on cups 2 of the fuel distributor. System 1 may therefore be developed as a fuel-injection system for the high-pressure injection in internal combustion engines, in particular. Fuel under high pressure is able to be supplied to the fuel distributor via a high-pressure pump.

Partially illustrated connection sleeve 3 of a fuel injector is connected to cup 2 by way of a holding element 4. Holding element 4 has at least essentially straight legs 5, 6, which are guided through at least one recess 7, 8 in a wall 9 of cup 2. In this exemplary embodiment, two recesses 7, 8 are provided, which are realized by through bores. Recesses 7, 8 are at least approximately situated in a plane that is oriented perpendicular to an axis 10 of cup 2.

The development of system 1 of the first exemplary embodiment will be described in greater detail in the following text also with reference to FIGS. 2 and 3.

Figure 2:
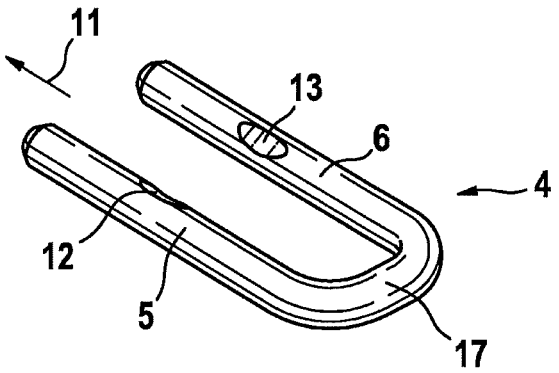
FIG. 2 shows a holding element of the system shown in FIG. 1, in a schematic three-dimensional view, corresponding to the first exemplary embodiment of the present invention.

FIG. 2 shows a holding element 4 of system 1 illustrated in FIG. 1 in a schematic three-dimensional view, corresponding to the first exemplary embodiment. First leg 5 and second leg 6 of holding element 4 are preferably not oriented parallel with each other in an initial state. With regard to a joining direction 11, in which legs 5, 6 of holding element 4 are guided through recesses 7, 8 during the assembly, legs 5, 6, for example, may run toward each other to some degree or run apart slightly, so that no precise parallel development comes about. Appropriate spreading or compression of legs 5, 6 then enables them to be inserted into through bores 7, 8, which are preferably developed to run parallel to each other. This produces a clamping force in the assembled state, as it is shown in FIG. 1. Holding element 4 is thereby secured and will not fall out of cup 2.

An embossed region 12 on leg 5 is provided in this exemplary embodiment in addition. Furthermore, an embossed region 13 is present on leg 6. Embossed regions 12, 13 provide contact surfaces 12, 13 on legs 5, 6 of holding element 4.

Figure 3:
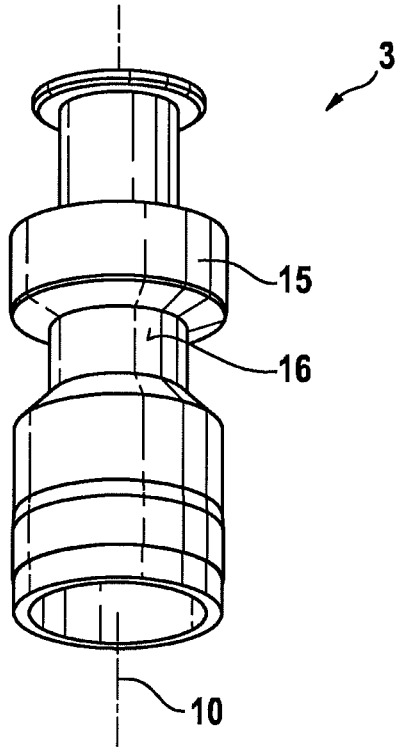
FIG. 3 shows the connection sleeve of a fuel injector of the system shown in FIG. 1, in an excerpted schematic three-dimensional view, corresponding to the first exemplary embodiment of the present invention.

FIG. 3 shows an excerpted schematic three-dimensional view of a connection sleeve 3 of a fuel injector of system 1 shown in FIG. 1, corresponding to the first exemplary embodiment. Connection sleeve 3 includes a collar 15. Collar 15 of connection sleeve 3 rests against contact surfaces 12, 13 of legs 5, 6 of holding element 4. This creates a keyed connection between collar 15 of connection sleeve 3 of the fuel injector and legs 5, 6 of holding element 4. This keyed connection retains holding element 4 in cup 2 and thus prevents it from falling out.

This exemplary embodiment therefore provides two safety mechanisms are therefore provided, which ensure that holding element 4 will not fall out of cup 2. For one, a frictional connection is formed via the non-parallel legs 5, 6 of holding element 4 with respect to the cup. For another, a keyed connection is produced between holding element 4 and cup 2 via contact surfaces 12, 13. Depending on the application case, it is also possible to realize only one of these two safety methods.

In this exemplary embodiment, contact surfaces 12, 13 are developed by embossed regions 12, 13, but other developments are possible as well. Furthermore, the keyed connection between the collar of fuel injector 3 and at least one of legs 5, 6 of holding element 4, which fixates holding element 4 relative to cup 2, is also realizable in a manner other than by contact surfaces 12, 13 on legs 5, 6.

in this exemplary embodiment, the frictional connection for the purpose of clamping holding element 4 relative to cup 2 furthermore is realized in that legs 5, 6 are pivoted in the at least one recess 7, 8.

Collar 15 of connection sleeve 3 of the fuel injector thus is braced on legs 5, 6 of holding element 4. This prevents the fuel injector from being pulled out of cup 2 along axis 10 and therefore ensures reliable mounting, which also permits a certain play of the fuel injector in relation to cup 2. In particular, a suspension is able to be achieved through a constructive development that enables the fuel injector to pivot relative to cup 2 within certain limits.

In this exemplary embodiment, holding clamp 4 is developed in a U-shape and thereby allows a cost-effective production. In addition, little space is required and the use of material is optimized. Holding element 4, in particular, may be manufactured from a metal wire of appropriate thickness, which is bent and embossed as needed.

Contact surfaces 12, 13 furthermore allow reduced contact pressure in the region where contact takes place between collar 15 of connection sleeve 3 and holding element 4. This reduces material stressing. Preferably slight pivoting of the fuel injector in cup 2 is able to be achieved or facilitated by a suitable design of contact surfaces 12, 13 and/or a suitable design of collar 15. Low clearances of the support points of legs 5, 6 of holding element 4 in cup 2 and contact surfaces 12, 13 for connection sleeve 3 also allow the cross-section of holding element 4 to be reduced, especially to allow the use of smaller wire thicknesses.

Connection sleeve 3 of the fuel injector has an outer side 16 in the form of a cylindrical sleeve, at which an outer diameter of connection sleeve 3 is smaller than on collar 5. Legs 5, 6 have a slight radial clearance with respect to outer side 16, shaped like a cylinder sleeve, of connection sleeve 3 of the fuel injector.

Figure 4:
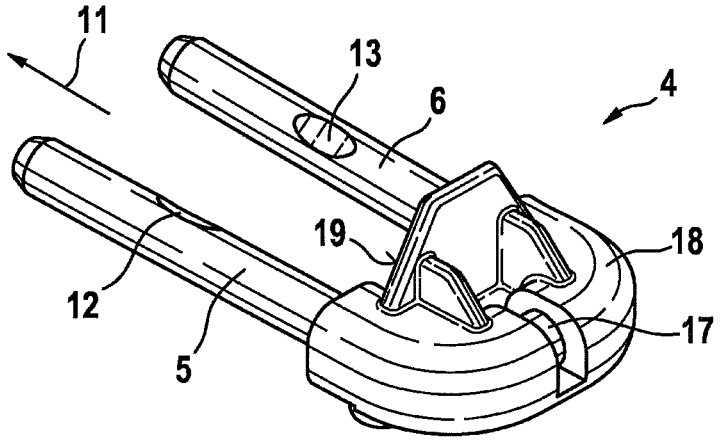
FIG. 4 shows the holding element, shown in FIG. 2, of a system in a schematic, three-dimensional view, corresponding to a second specific embodiment of the present invention.

FIG. 4 shows a schematic three-dimensional representation of holding element 4, shown in FIG. 2, of a system 1, corresponding to a second exemplary embodiment. In this exemplary embodiment, a stop part 18, connected to bracket 17, is provided on bracket 17 of holding element 4 that interconnects legs 5, 6. Stop part 18, for example, may be in the form of an at least partial extrusion-coat of bracket 17. Stop part 18 forms a stop 19, which strikes against an outer side 20 of cup 2 during the assembly. This ensures a correct installation position.

Figure 5:
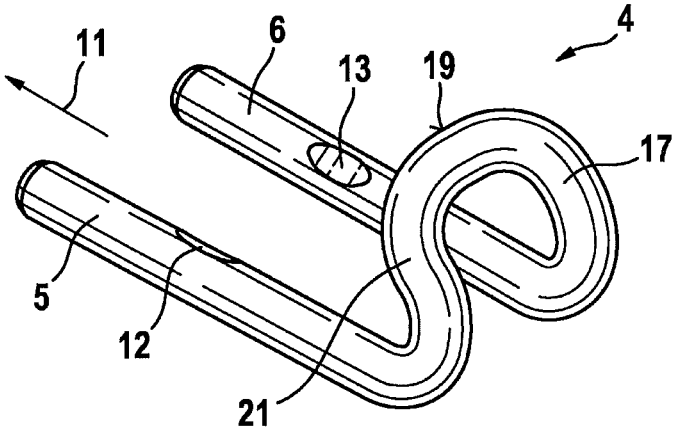
FIG. 5 shows the holding element, shown in FIG. 2, of a system in a schematic, three-dimensional view, corresponding to a third specific embodiment of the present invention.

FIG. 5 shows a schematic three-dimensional representation of a holding element 4, shown in FIG. 2, of a system 1 corresponding to a third exemplary embodiment. In this exemplary embodiment, bracket 17 has a folded-over portion 21, which forms stop 19. This ensures a correct installation position of holding element 4.

Figure 6:
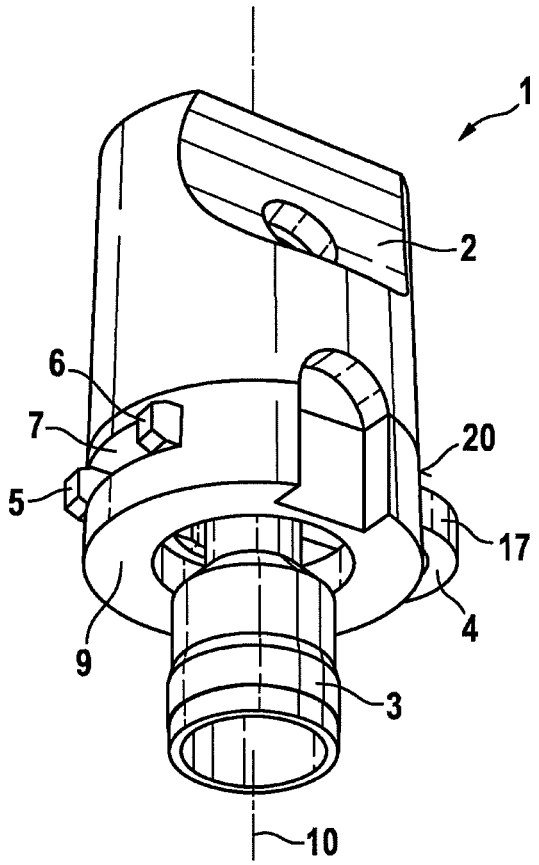
FIG. 6 shows the system shown in FIG. 1, in an excerpted, schematic three-dimensional view, corresponding to a fourth exemplary embodiment of the present invention.

FIG. 6 shows an excerpted schematic three-dimensional view of system 1, shown in FIG. 1, including a cup 2 and a connection sleeve 3 of a fuel injector, according to a fourth exemplary embodiment. In this exemplary embodiment, a recess 7, through which the two legs 5, 6 of holding element 4 extend, is provided in wall 9. In this exemplary embodiment, holding element 4 furthermore has an at least approximately rectangular profile. Especially the two legs 5, 6 of holding element 4 have an at least roughly rectangular profile. Bracket 17 of holding element 4 has a rectangular profile in this exemplary embodiment as well, and holding element 4 is embodied in the form of a U-shaped holding element 4.

Figure 7:
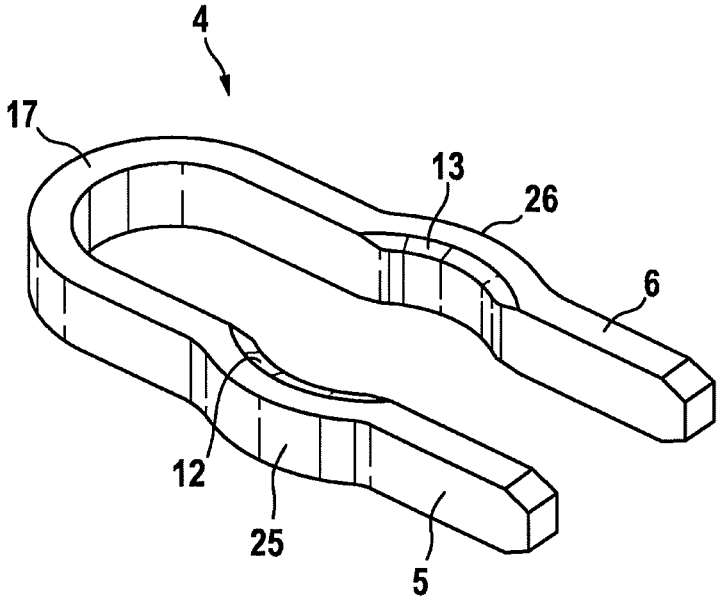
FIG. 7 shows a holding element of the system shown in FIG. 5, in a schematic three-dimensional view, corresponding to the fourth exemplary embodiment of the present invention.

FIG. 7 shows a schematic three-dimensional view of holding element 4 of the system shown in FIG. 5 corresponding to the fourth exemplary embodiment. Legs 5, 6 include embossed regions 12, 13, which constitute contact surfaces 12, 13 for collar 15 of connection sleeve 3. In the region of cylinder-sleeve-shaped outer side 16 of connection sleeve 3, legs 5, 6 moreover are provided with fixation sections 25, 26, which are bent outward in relation to axis (longitudinal axis) 10 of cup 2 or connection sleeve 3 of the fuel injector. In this exemplary embodiment, cylinder-sleeve-shaped outer side 16 is used as potential contact surface for fixation sections 25, 26 of legs 5, 6. Fixation sections 25, 26 of legs 5, 6 have a low radial clearance with respect to cylinder-sleeve-shaped outer side 16 of connection sleeve 3 of the fuel injector. This produces a keyed connection, which reliably prevents holding element 4 from falling out of cup 2 in the assembled state.

System 1 according to the fourth exemplary embodiment, described on the basis of FIGS. 6 and 7, has the advantage that especially large contact surfaces are able to be provided between holding element 4 and connection sleeve 3. In addition, a stable geometry results, which allows higher pressures.

The present invention is not restricted to the exemplary embodiments described.

What is claimed is:

1. A system, comprising:

a fuel distributor; and a plurality of fuel injectors, each fuel injector being situated on an associated cup of the fuel distributor, and at least one of the fuel injectors being fastened to the associated cup by a holding element, wherein:

the holding element has an at least substantially straight first leg and an at least substantially straight second leg, the cup has at least one through hole extending through a wall of the cup, the first leg and the second leg are at least partially routed through the at least one through hole, and a connection sleeve of the fuel injector has a collar that is braced on the first leg of the holding element and on the second leg of the holding element such that the first leg and the second leg are at least partially situated between, in a direction perpendicular to a longitudinal axis of the cup, the collar and a respective inner side of the cup in order to secure the fuel injector on the cup, wherein, with respect to a joining direction of the holder and the cup, an upper inner side of each leg adjoins the collar and an outer side of each leg adjoins the inner side of the cup, wherein the joining direction is perpendicular to the longitudinal axis of the cup, wherein the fuel injector is clamped on the cup with a clamp directed through four through-holes in the wall of the injector cup.

2. The system as recited in claim 1, wherein the system is a fuel injection system for a high-pressure injection in an internal combustion engine.

3. The system as recited in claim 1, wherein the first leg and the second leg lie at least approximately in a plane that is perpendicular to a longitudinal axis of the cup.

4. The system as recited in claim 1, wherein the first leg and the second leg of the holding element are not oriented parallel to each other in an initial state.

5. The system as recited in claim 1, wherein the first leg and the second leg of the holding element are pivoted relative to each other so as to clamp the holding element in the at least one through hole.

6. The system as recited in claim 1, wherein at least one of:

a contact surface is present on the first leg of the holding element, on which the collar of the connection sleeve of the fuel injector rests against the first leg, and a contact surface is present on the second leg of the holding element, on which the collar of the connection sleeve of the fuel injector rests against the second leg.

7. The system as recited in claim 6, wherein the contact surface of the first leg includes an embossed region, and the contact surface of the second leg includes an embossed region.

8. The system as recited in claim 1, wherein at least one of:

a keyed connection is present between the first leg of the holding element and the collar of the connection sleeve of the fuel injector, which fixates the holding element relative to the cup, and a keyed connection is formed between the second leg of the holding element and the collar of the connection sleeve of the fuel injector, which fixates the holding element relative to the cup.

9. The system as recited in claim 1, wherein at least one of:

the first leg of the holding element has a rectangular profile, and the second leg of the holding element has a rectangular profile.

10. The system as recited in claim 1, wherein at least one of:

in a region of the connection sleeve of the fuel injector, the first leg has a fixation section which is bent radially outward in relation to a longitudinal axis of the cup, and the second leg has a fixation section in the region of the connection sleeve of the fuel injector, the fixation section of the second leg being is bent radially outward in relation to the longitudinal axis of the cup.

11. The system as recited in claim 10, wherein:

the connection sleeve of the fuel injector has a contact surface which is at least partially developed in a shape of a cylindrical sleeve, and one of the fixation section of the first leg and the fixation section of the second leg has a low radial clearance at the contact surface of the connection sleeve.

12. The system as recited in claim 1, wherein:

the holding element includes a bracket that connects the first leg to the second leg, and a stop on the bracket strikes against an outer side of the cup.

13. The system as recited in claim 12, wherein the stop of the bracket is formed by a folded-over part of the bracket.

14. The system as recited in claim 12, wherein the stop of the bracket is formed by a stop part that is connected to the bracket.

15. A system, comprising:

a fuel distributor; and a plurality of fuel injectors, each fuel injector being situated on an associated cup of the fuel distributor, and at least one of the fuel injectors being fastened to the associated cup by a holding element, wherein:

the holding element has an at least substantially straight first leg and an at least substantially straight second leg, the cup has at least two through holes extending through a wall of the cup, the first leg and the second leg are at least partially routed through a respective through hole of the at least two through holes, and a connection sleeve of the fuel injector has a collar that is braced on the first leg of the holding element and on the second leg of the holding element in order to secure the fuel injector on the cup, wherein two through holes of the at least two through holes extend through the wall of the cup to respectively two opposite sides of the wall, wherein the two through holes are in the form of through-bores, and wherein the wall is circumferentially closed except for the through holes.

16. The system as recited in claim 15, wherein the system is a fuel injection system for a high-pressure injection in an internal combustion engine.

17. The system as recited in claim 15, wherein the first leg and the second leg lie at least approximately in a plane that is perpendicular to a longitudinal axis of the cup.

18. The system as recited in claim 15, wherein the first leg and the second leg of the holding element are not oriented parallel to each other in an initial state.

19. The system as recited in claim 15, wherein the first leg and the second leg of the holding element are pivoted relative to each other so as to clamp the holding element in the at least two through holes.

20. The system as recited in claim 15, wherein at least one of:

a contact surface is present on the first leg of the holding element, on which the collar of the connection sleeve of the fuel injector rests against the first leg, and a contact surface is present on the second leg of the holding element, on which the collar of the connection sleeve of the fuel injector rests against the second leg.

21. The system as recited in claim 20, wherein the contact surface of the first leg includes an embossed region, and the contact surface of the second leg includes an embossed region.

22. The system as recited in claim 15, wherein at least one of:

a keyed connection is present between the first leg of the holding element and the collar of the connection sleeve of the fuel injector, which fixates the holding element relative to the cup, and a keyed connection is formed between the second leg of the holding element and the collar of the connection sleeve of the fuel injector, which fixates the holding element relative to the cup.

23. The system as recited in claim 15, wherein at least one of:

the first leg of the holding element has a rectangular profile, and the second leg of the holding element has a rectangular profile.

24. The system as recited in claim 15, wherein at least one of:

in a region of the connection sleeve of the fuel injector, the first leg has a fixation section which is bent radially outward in relation to a longitudinal axis of the cup, and the second leg has a fixation section in the region of the connection sleeve of the fuel injector, the fixation section of the second leg being is bent radially outward in relation to the longitudinal axis of the cup.

25. The system as recited in claim 24, wherein:

the connection sleeve of the fuel injector has a contact surface which is at least partially developed in a shape of a cylindrical sleeve, and one of the fixation section of the first leg and the fixation section of the second leg has a low radial clearance at the contact surface of the connection sleeve.

26. The system as recited in claim 15, wherein:

the holding element includes a bracket that connects the first leg to the second leg, and a stop on the bracket strikes against an outer side of the cup.

27. The system as recited in claim 26, wherein the stop of the bracket is formed by a folded-over part of the bracket.

28. The system as recited in claim 26, wherein the stop of the bracket is formed by a stop part that is connected to the bracket.

29. A system, comprising:

a fuel distributor; and a plurality of fuel injectors, each fuel injector being situated on an associated cup of the fuel distributor, and at least one of the fuel injectors being fastened to the associated cup by an at least substantially straight first leg and an at least substantially straight second leg, wherein:

the cup has at least one through hole extending through a wall of the cup, the at least substantially straight first leg and the at least substantially straight second leg are at least partially routed through the at least one through hole, and a connection sleeve of the fuel injector has a collar that is braced on the at least substantially straight first leg and on the at least substantially straight second leg such that the at least substantially straight first leg and the at least substantially straight second leg are at least partially situated between, in a direction perpendicular to a longitudinal axis of the cup, the collar and a respective inner side of the cup in order to secure the fuel injector on the cup, wherein, with respect to a joining direction of the holder and the cup, an upper inner side of each leg adjoins the collar and an outer side of each leg adjoins the inner side of the cup, wherein the joining direction is perpendicular to the longitudinal axis of the cup.

30. The system as recited in claim 29, wherein the at least substantially straight first leg and the at least substantially straight second leg lie at least approximately in a plane that is perpendicular to a longitudinal axis of the cup.

31. The system as recited in claim 29, wherein at least one of:

a contact surface is present on the at least substantially straight first leg, on which the collar of the connection sleeve of the fuel injector rests against the at least substantially straight first leg, and a contact surface is present on the at least substantially straight second leg, on which the collar of the connection sleeve of the fuel injector rests against the at least substantially straight second leg.

32. The system as recited in claim 31, wherein the contact surface of the at least substantially straight first leg includes an embossed region, and the contact surface of the at least substantially straight second leg includes an embossed region.

33. The system as recited in claim 29, wherein at least one of:

a keyed connection is present between the at least substantially straight first leg and the collar of the connection sleeve of the fuel injector, which fixates the at least substantially straight first leg relative to the cup, and a keyed connection is formed between the at least substantially straight second leg and the collar of the connection sleeve of the fuel injector, which fixates the at least substantially straight second leg relative to the cup.

34. The system as recited in claim 29, wherein at least one of:

the at least substantially straight first leg has a rectangular profile, and the at least substantially straight second leg has a rectangular profile.

35. The system as recited in claim 29, wherein at least one of:

in a region of the connection sleeve of the fuel injector, the at least substantially straight first leg has a fixation section which is bent radially outward in relation to a longitudinal axis of the cup, and the at least substantially straight second leg has a fixation section in the region of the connection sleeve of the fuel injector, the fixation section of the at least substantially straight second leg is bent radially outward in relation to the longitudinal axis of the cup.

36. The system as recited in claim 35, wherein:

the connection sleeve of the fuel injector has a contact surface which is at least partially developed in a shape of a cylindrical sleeve, and one of the fixation section of the at least substantially straight first leg and the fixation section of the at least substantially straight second leg has a low radial clearance at the contact surface of the connection sleeve.

37. A high-pressure fuel injection system for an internal combustion engine, comprising:

a fuel distributor; and a plurality of fuel injectors, each fuel injector being situated on an associated cup of the fuel distributor, and at least one of the fuel injectors being fastened to the associated cup by a holding element, wherein:

the holding element has an at least substantially straight first leg and an at least substantially straight second leg, the cup has at least one recess extending through a wall of the cup, the first leg and the second leg are at least partially routed through the at least one recess, and a connection sleeve of the fuel injector has a collar that is braced on the first leg of the holding element and on the second leg of the holding element in order to secure the fuel injector on the cup, wherein two recesses are developed in the form of through holes which extend on respectively two opposite sides of the wall at least approximately in a plane that is perpendicular to an axis of the cup, wherein the first leg and the second leg of the holding element have a circular cross section, wherein the first leg and the second leg of the holding element are not oriented parallel to each other in an initial state so that the legs run toward each other or run apart from each other, thereby allowing for an insertion into the through holes developed to run parallel to each other, and producing, in the assembled state, a clamping force of the legs with respect to the cup.

* * * * *